United States Patent [19]

Kemp, Jr.

[11] Patent Number: 4,763,423

[45] Date of Patent: Aug. 16, 1988

[54] METHOD FOR DRYING FINE METAL POWDERS

[75] Inventor: Preston B. Kemp, Jr., Athens, Pa.

[73] Assignee: GTE Products Corporation, Stamford, Conn.

[21] Appl. No.: 70,289

[22] Filed: Jul. 6, 1987

[51] Int. Cl.[4] ..... F26B 3/00

[52] U.S. Cl. ..... 34/9

[58] Field of Search ..... 34/9; 134/10, 11, 12, 134/105, 109

[56] References Cited

U.S. PATENT DOCUMENTS

| | | | |
|---|---|---|---|
| 3,653,983 | 4/1972 | Ziehr et al. | 34/9 X |
| 3,903,012 | 9/1975 | Brandreth | 34/9 X |
| 4,105,747 | 8/1978 | Eisele et al. | 34/9 X |
| 4,286,390 | 9/1981 | Convers et al. | 34/9 |
| 4,686,774 | 8/1987 | Hiraiwa et al. | 34/9 |
| 4,696,114 | 9/1987 | Duval | 34/9 |

*Primary Examiner*—Steven E. Warner

*Attorney, Agent, or Firm*—Donald R. Castle; L. Rita Quatrini

[57] ABSTRACT

A method is disclosed for removing essentially all of the water from fine metal powders. The method involves contacting the powder particles which have water on at least some of the particle surfaces with a solution of a fluorocarbon solvent and a hydrophobic surfactant, with the amount of the surfactant being sufficient to form at least a monolayer adsorbed onto the particle surfaces, and with the amount of the solution being sufficient to at least fill the void volume of the particles, to displace essentially all of the water which is in contact with the water. The displaced water and the major portion of the solution which is not in direct contact with the powder is physically removed from the resulting treated powder. The powder is then dried at a temperature above the vaporization temperature of the fluorocarbon at the operating pressure of the drying equipment to remove the remainder of the fluorocarbon from the treated powder without removing significant amounts of surfactant therefrom. Alternately, if it is desired that the remainder of the surfactant be removed, the treated powder is dried at a temperature above the vaporization temperature of the surfactant.

16 Claims, No Drawings

METHOD FOR DRYING FINE METAL POWDERS

This invention relates to a method for removing essentially all of the water from fine metal powder which involves contacting the powder with solution of a fluorocarbon solvent and a hydrophobic surfactant to displace the water from the powder. This method is less energy intensive and yields lower oxygen contents than prior art techniques.

BACKGROUND OF THE INVENTION

In conventional drying processes, water is removed as a vapor from the surfaces of fine metal powders, that is, powders having an average size of less than about 100 micrometers in diameter. (The powder is heated until the water boils away.) This technique is energy intensive because (1) water has a high heat of vaporization, (2) water tends to bond to the metal powder surfaces and (3) fine metal powders tend to have a high surface area.

It is necessary to remove the water thoroughly from the metal powder before the powder can be used in applications such as in plasma processing and rapid solidification processes. If even small amounts of water are allowed to remain on the powder, there is risk of degrading the chemistry of the powder by increasing the oxygen content of the powder. Also, residual water on metal powder particle surfaces, especially powders of fine particle size such as less than 10 micrometers in diameter, can promote pyrophoricity. Also residual water can also agglomerate the powder and make it stick together.

Therefore, a method to economically and thoroughly dry fine metal powders for subsequent processing, such as plasma melting and rapid solidification would be highly desirable.

SUMMARY OF THE INVENTION

In accordance with one aspect of this invention, there is provided a method for removing essentially all of the water from fine metal powders. The method involves contacting the powder particles which have water on at least some of the particle surfaces with a solution of a fluorocarbon solvent and a hydrophobic surfactant, with the amount of the surfactant being sufficient to form at least a monolayer adsorbed onto the particle surfaces, and with the amount of the solution being sufficient to at least fill the void volume of the particles, to displace essentially all of the water which is in contact with the water. The displaced water and the major portion of the solution which is not in direct contact with the powder is physically removed from the resulting treated powder. The powder is then dried at a temperature above the vaporization temperature of the fluorocarbon at the operating pressure of the drying equipment to remove the remainder of the fluorocarbon from the treated powder without removing significant amounts of surfactant therefrom.

In accordance with another aspect of this invention, if it is desired that the remainder of the surfactant be removed, the treated powder is dried at a temperature above the vaporization temperature of the surfactant.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

By the method of the present invention water is essentially completely removed from fine metal powder by being displaced from the powder, The method is both effective and energy efficient.

The method of the present invention is applicable to any metal powder. However it is applicable especially to metal powders having an average particle size of less than about 100 micrometers in diameter and more typically less than about 30 micrometers in diameter. It is applicable to particles as small as less than about 10 micrometers in average diameter. These fine powders are very difficult to dry by conventional techniques because of their large surface area.

The invention is not limited to any specific metal powders. However, the invention is applicable especially to iron powder, ferrous alloys such as stainless steel powders, and copper and its alloys.

In accordance with a preferred embodiment, any excess water is first removed from the metal powder. By excess water is meant the water which is present to form a slurry with the powder. This excess water is removed most preferably by subjecting the water and powder slurry to standard liquids-solids separation techniques such as centrifugation, decantation, filtration and combinations of these.

The resulting powder has enough water to wet at least some of the surfaces of the particles but not enough to form a slurry. The powder is typically in the form of a semi-dry cake. This semi-dry powder is contacted with a solution of a hydrophobic surfactant in a fluorocarbon solvent.

The fluorocarbon can be any liquid fluorocarbon. The most preferred fluorocarbon is trichlortrifluoroethane. A preferred source of trichlorotrifluoroethane is manufactured by Allied Corporation under the name of Genesolv ®-D.

In actuality any hydrophobic surfactant can be used. However, it is preferred to use an oil soluble cationic type of surfactant. One especially preferred oil soluble cationic surfactant is a fatty imidazoline surfactant manufactured by Witco Chemical Co. under the name of Witcomul PA-78B or Witcamine PA-78B.

The amount of surfactant and fluorocarbon solution should at least fill the void volume of the powder. Preferably the level of solution should be above the level of the powder. As far as the surfactant itself, the amount of surfactant should be sufficient to form at least an adsorbed monolayer on the powder particle surfaces. Therefore, the amount of surfactant is based on the surface area of the powder particles. Given these requirements, anyone of ordinary skill in the art can determine how much solution and surfactant must be used, and the invention is not limited to such. It has been found that to accomplish these ends, as a guideline, for about 1000 g of fine powder, typically about 2,000 ml of solution is satisfactory. Usually, the surfactant makes up about 0.1% by volume, of the solution, although larger amounts of surfactant can be used if desired.

The powder, fluorocarbon, and surfactant are contacted by conventional slurry techniques.

The surfactant speeds the release of water from the metal powder particle surfaces via two mechanisms: (1) increasing the contact angle at the water/metal interface by adsorbing onto the metal powder particle surfaces, and (2) lowering the interfacial tension between the water and the fluorocarbon.

Essentially all of the displaced water and the major portion of the solution which is not in direct contact with the particles are then physically removed from the surfactant treated powder. It is preferred to use methods in which remixing of the water with the powder is avoided. This is the reason that decantation or centrifugation are the preferred methods. A damp cake remains after this step.

At this point it may be desirable to remove some of the surfactant from the powder. This is done if the powder is to be used in applications in which low carbon is required or in which other contaminants from the surfactant are undesirable. This is done by contacting the surfactant-treated powder, (the damp cake), with a fluorocarbon solvent to solubilize any surfactant which is in excess of that required to form a monolayer on the surfaces of the particles and to solubilize the major portion of the surfactant which is actually present as the monolayer. In this step, the fluorocarbon solvent in effect washes some of the surfactant off the powder. The fluorocarbon solvent is the type described previously.

The resulting surfactant-solvent solution is then removed from the particles by any standard liquid-solid separation method.

After this solvent washing step, or, if this washing step is not carried out, after the physical removal of the displaced water and solution, the damp cake is dried. This is done by conventional techniques used for metal powders such as rotating or tumbling vacuum dryers, or flash dryers. Depending on what the specific application is going to be for the powder, the remaining surfactant can be removed, or allowed to remain on the powder. If it is desired that the surfactant remain on the powder, the cake is dried above the vaporization temperature of the fluorocarbon at the operating pressure of the drying equipment to remove the remainder of the fluorocarbon. The temperature must not go above the vaporization temperature of the surfactant because the surfactant is to remain on the powder. It is assumed here that the vaporization temperature of the surfactant will be higher than the vaporization temperature of the fluorocarbon under similar operating conditions. If it is desired to remove the surfactant along with the solvent, the cake is heated at a temperature above the vaporization temperature of the surfactant at the operating pressure of the drying equipment to remove the surfactant. The fluorocarbon will also be removed.

To more fully illustrate this invention, the following nonlimiting examples are presented. All parts, portions, and percentages are on a weight basis unless otherwise stated.

EXAMPLE 1

Attritor milled ferrous alloy powder having an average particle size of less than about 50 micrometers in diameter is deliberately wetted by being mixed with water in the presence of air for about 4 minutes. The powder is allowed to settle, and the excess water is decanted. The remaining water is displaced by slurrying the powder with a 0.5% by volume solution of Witcomine PA-78B fatty imidazoline surfactant in Genesolv ®D solvent (trichlorotrifluoroethane). The powder is allowed to settle, and the excess fluid that is the water layer+excess fluorocarbon/surfactant solution is decanted. The powder is rinsed once with pure Genesolv ®D solvent, allowed to settle, and the resulting surfactant-solvent solution is decanted. The damp powder is dried on a steam table at about 100° C. until the powder is free flowing and appears dry. The powder is then placed in a vacuum oven and evacuated to about −29" Hg overnight. The starting attritor milled ferrous alloy powder and the powder wet with water and displacement dried are analyzed. A summary of some analyses on the powder before and after water wetting and displacement drying is given in Table 1 below.

TABLE 1

| Sample description | Wt. % C | Wt. % $O_2$ | Wt. % $N_2$ |
|---|---|---|---|
| Material before water wetting | 0.65 | 1.0 | 15 |
| Material wet with water and displacement dried | 0.77 | 1.0 | 200 ppm |

While the carbon content of the displacement dried powder increases primarily due to the residual surfactant on the powder particles, the oxygen content remains the same, that is, the drying did not add oxygen to the powder. Nitrogen content increases during drying but it is still well within acceptable limits for this material.

EXAMPLE 2

Fine atomized copper powder having an average particle size of from about 7 to about 30 micrometers in diameter is used for a series of experiments comparing displacement drying with other techniques for drying powder which is wet with water. As a control, the as-received powder and powder mixed with pure Genesolv ®D solvent and dried, is analyzed. The other powder samples are vigorously mixed with water for about 8 minutes, allowed to settle, and the excess water is decanted. The samples are then dried using three techniques: (1) drying on a steam bath in air at about 100° C., (2) vacuum baking at about 220° C., and (3) displacement drying according to the method of the present invention with the fluorocarbon/surfactant solution used in Example 1. The chemical analysis results are given in Table 2 below.

TABLE 2

| No. Sample description Mixed with: | Dried by: | C ppm | $O_2$ ppm | $N_2$ ppm |
|---|---|---|---|---|
| As is (starting) Control | | 40 | 750 | 30 |
| Genesolv ® D Control | steam | 55 | 820 | 50 |
| (1) Water | steam | 45 | 1000 | 250 |
| (2) Water | vacuum | 45 | 950 | 190 |
| (3) Water | displacement/steam | 85 | 840 | 190 |

The oxygen content of the powder mixed with water and displacement/steam table dried is comparable to the powder mixed with pure Genesolv ®D solvent and steam table/vacuum dried. Also, the oxygen content is significantly lower than that obtained by either steam table or vacuum drying.

The carbon and nitrogen contents of all samples are within acceptable ranges.

EXAMPLE 3

Carbonyl iron powder having an average particle size of less than about 10 micrometers in diameter of the type HP-CIP supplied by GAF Corporation is vigorously mixed for about 8 minutes with water in air and then (1) dried at about 100° C. on a steam table (in air) and (2) displacement dried with the same surfactant-solvent solution as in Examples 1 and 2. Another sample of the powder is vigorously mixed for about 8 minutes with pure Genesolv ®D solvent in air and dried at about 100° C. on a steam table (in air) as a control. The chemical analyses are given in Table 3 below.

TABLE 3

| Sample description Mixed with: | Dried by: | % $O_2$ | $N_2$ ppm |
|---|---|---|---|
| As is (starting) | | 0.21 | 150 |
| Control | | | |
| Genesolv ® D | steam | 0.21 | 180 |
| Control | | | |
| (1) Water | steam | 0.49 | 120 |
| (2) Water | displacement/ steam | 0.25 | 170 |

The powder mixed with the pure solvent and dried does not change in oxygen content.

For the samples mixed with water, the powder dried on the steam table (prior art) in air increased about 133% in oxygen content, but the powder dried by displacement of water by the fluorocarbon/surfactant solution according to the present invention does not significantly increase in oxygen. The nitrogen content of all the samples is well within acceptable limits.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for drying fine metal powders, said method comprising:

(a) contacting said metal powder, having water on at least some of the surfaces of its particles with a solution of a fluorocarbon solvent and a hydrophobic surfactant, with the amounts of said surfactant in said solution being sufficient to form at least a monolayer adsorbed onto said surfaces, and with the amount of said solution being sufficient to at least fill the void volume of said particles to displace essentially all of the water which is in contact with said powder;

(b) physically removing essentially all of the displaced water and the major portion of the solution which is not in direct contact with said particles, from the resulting surfactant-treated powder; and (c) drying said surfactant-treated powder at a temperature above the vaporization temperature of said fluorocarbon at the operating pressure of the drying equipment to remove the remainder of said fluorocarbon from said metal powder without removing significant amounts of any surfactant remaining on said powder, to produce the dried metal powder.

2. A method of claim 1 comprising the additional steps after step (b) and before step (c):

(a) contacting said surfactant-treated powder with a fluorocarbon solvent to solubilize any surfactant which is in excess of that required to form a monolayer on the surfaces of said particles and to solubilize the major portion of the surfactant which is present as said monolayer; and (b) removing the resulting surfactant-fluorocarbon solution from said particles.

3. A method of claim 1 wherein said fluorocarbon is trichlorotrifluoroethane.

4. A method of claim 1 wherein said surfactant is an oil soluble cationic type.

5. A method of claim 4 wherein said surfactant is a fatty imidazoline.

6. A method of claim 1 wherein said fine metal powder has an average particle size of less than about 100 micrometers in diameter.

7. A method of claim 6 wherein said particle size is less than about 30 micrometers in diameter.

8. A method of claim 7 wherein said particle size is less than about 10 micrometers in diameter.

9. A method for drying fine metal powders, said method comprising:

(a) contacting said metal powder, having water on at least some of the surfaces of its particles with a solution of a fluorocarbon solvent and a hydrophobic surfactant, with the amounts of said surfactant in said solution being sufficient to form at least a monolayer adsorbed onto said surfaces, and with the amount of said solution being sufficient to at least fill the void volume of said particles to displace essentially all of the water which is in contact with said powder;

(b) physically removing essentially all of the displaced water and the major portion of the solution which is not in direct contact with said particles, from the resulting surfactant-treated powder; and (c) drying said surfactant-treated powder at a temperature above the vaporization temperature of said surfactant at the operating pressure of the drying equipment to remove the remainder of said surfactant from said metal powder to produce the dried metal powder.

10. A method of claim 9 comprising the additional steps after step (b) and before step (c):

(a) contacting said surfactant-treated powder with a fluorocarbon solvent to solubilize any surfactant which is in excess of that required to form a monolayer on the surfaces of said particles and to solubilize the major portion of the surfactant which is present as said monolayer; and (b) removing the resulting surfactant-fluorocarbon solution from said particles.

11. A method of claim 9 wherein said fine metal powder has an average particle size of less than about 100 micrometers in diameter.

12. A method of claim 11 wherein said particle size is less than about 30 micrometers in diameter.

13. A method of claim 12 wherein said particle size is less than about 10 micrometers in diameter.

14. A method of claim 9 wherein said fluorocarbon is trichlorotrifluoroethane.

15. A method of claim 14 wherein said surfactant is an oil soluble cationic type.

16. A method of claim 15 wherein said surfactant is a fatty imidazoline.

* * * * *